US007540702B2

(12) United States Patent
Furthmueller

(10) Patent No.: US 7,540,702 B2
(45) Date of Patent: Jun. 2, 2009

(54) DEVICE FOR STACKING FLAT PRODUCTS

(75) Inventor: Stefan Furthmueller, Welzheim-Breitenfüuerst (DE)

(73) Assignee: Wilhelm Bahmueller Maschinenbau-Praezisionswerkzeuge GmbH, Pluederhausen (DE)

( * ) Notice: Subject to any disclaimer, the term of this patent is extended or adjusted under 35 U.S.C. 154(b) by 269 days.

(21) Appl. No.: 11/129,406

(22) Filed: May 16, 2005

(65) Prior Publication Data

US 2006/0263195 A1 Nov. 23, 2006

(51) Int. Cl.

| | |
|---|---|
| ***B65G 57/09*** | (2006.01) |
| ***B65G 57/30*** | (2006.01) |
| ***B65H 29/00*** | (2006.01) |
| ***B65H 33/08*** | (2006.01) |

(52) U.S. Cl. ..... 414/794.4; 198/817; 198/626.3; 414/794.9

(58) Field of Classification Search ..... 414/790.3, 414/788.3, 790.2, 790.8, 791, 792.2, 794.4, 414/792.7, 795.3; 198/412, 457.03, 626.3, 198/861.1, 626.4, 817; 271/218, 182, 186
See application file for complete search history.

(56) References Cited

U.S. PATENT DOCUMENTS

| | | | | | |
|---|---|---|---|---|---|
| 2,133,727 | A | * | 10/1938 | Staude | 271/216 |
| 3,970,202 | A | * | 7/1976 | Speggiorin et al. | 414/788.3 |
| 4,433,774 | A | * | 2/1984 | Lopes | 83/94 |
| 4,810,153 | A | * | 3/1989 | Armelin | 414/790.1 |
| 5,435,433 | A | * | 7/1995 | Jordan et al. | 198/626.5 |
| 5,901,832 | A | * | 5/1999 | Woolley et al. | 198/626.3 |
| 5,966,901 | A | * | 10/1999 | Komp et al. | 53/387.2 |
| 6,571,938 | B2 | * | 6/2003 | Gilmore | 198/812 |
| 2002/0020605 | A1 | * | 2/2002 | Muller | 198/369.1 |
| 2006/0263193 | A1 | * | 11/2006 | Furthmuller | 414/792.7 |

FOREIGN PATENT DOCUMENTS

| | | | |
|---|---|---|---|
| DE | 2361449 B | * | 4/1975 |
| JP | 61162413 A | * | 7/1986 |

* cited by examiner

*Primary Examiner*—Gregory W Adams
(74) *Attorney, Agent, or Firm*—Paul Vincent

(57) ABSTRACT

The invention concerns a device for stacking flat products, in particular, folding boxes, comprising a lower and upper transport unit, wherein the flat products are transported between the transport units in the direction of a stack shaft, each transport unit comprising at least one conveyor belt, wherein the position of the front end, facing the stack shaft, of at least one conveyor belt can be adjusted and changed.

17 Claims, 2 Drawing Sheets

DEVICE FOR STACKING FLAT PRODUCTS

BACKGROUND OF THE INVENTION

The invention concerns a device for stacking flat products, in particular, folding boxes, comprising a lower and an upper transport unit, wherein the flat products are transported between the transport units in the direction of a stack shaft, wherein each transport unit comprises at least one conveyor belt.

There are a plurality of conventional devices for stacking flat products. DE 38 08 799 C2 discloses e.g. a means for transferring flat objects and combining them into piles. DE 33 21 584 A1 discloses a device for stacking folding boxes. DE 28 27 540 C2 and DE 24 37 475 C3 each disclose a stacking device for folding boxes. DE 37 35 486 C2 discloses a device for turning and stacking folded box blank parts and DE 30 38 058 C2 discloses a means for forming packets of blanks. All of these devices have the disadvantage that they can form only one single type of stack. Depending on the design of the flat product, in particular, of the folding box, it is, however, necessary to form a stack through down-stacking or up-stacking to prevent the products being stacked from jamming during stacking. For this reason, in conventional devices for change-over between two different flat products, e.g. between two folding boxes, not only the entire supply unit has to be adjusted to a new folding box, but it may also be necessary to replace the device for stacking the folding boxes with another stacking device which permits stacking in the other stacking mode. In other words, one folding box blank e.g. can merely be down-stacked, whereas another folding box blank can exclusively be up-stacked and requires a different stacking device. Changing of the stacking device requires time during which the entire production plant is inoperative.

When changing over from one folding box to another, in particular, if they have different and irregular contours, e.g. are L-shaped, it is sometimes even necessary to use another stacking device for stacking the folding boxes of different geometry, even though the stacking direction is not changed.

It is therefore the underlying purpose of the invention to provide a device of the above-mentioned type which considerably reduces the change-over time between different products to be stacked compared to prior art.

SUMMARY OF THE INVENTION

This object is achieved in accordance with the invention with a device of the above-mentioned type in that the position of the front end, facing the stack shaft, of at least one conveyor belt can be adjusted and changed.

In particular, for folding boxes having a non-rectangular geometry, e.g. L-shaped folding boxes, having a long and a short longitudinal side, the conveyor belts can be adjusted such that their separation from the end of the stack shaft is larger for the longer longitudinal side of the folding box than for the short longitudinal side of the folding box. The separation from the impinging surface in the stack shaft which the front edge of the folding box hits upon entering the stack shaft thereby substantially corresponds to the length of the respective longitudinal edge of the folding box. This means that the folding box is accurately transported by the conveyor belts until it is completely or almost completely located in the stack shaft. The geometry of the folding box is thereby irrelevant since the position of the front ends of the conveyor belts can be adjusted to the different geometries of the folding boxes.

In an inventive further development, each conveyor belt can be moved, as viewed in the transport direction, away from the end of the stack shaft by at least the length of the product to be stacked and irrespective of the other conveyor belts. Due to the fact that the conveyor belt can be moved away from or towards the stack shaft by a length which changes with different folding boxes, adjustments required for a change of folding boxes can be effected within a minimum amount of time and, in particular, automatically if the folding box data is stored in a device control means.

In accordance with the invention, the front and one rear end of at least one conveyor belt are each guided around a deflecting roller and the deflecting rollers are mounted to a common carriage which can be moved in or opposite to the transport direction. The front end of the conveyor belt is adjusted in a simple manner by moving the carriage by the desired amount. The length of the conveyor belt does thereby not change, since the front deflecting roller is moved by the same amount and in the same direction as the rear deflecting roller.

The invention permits exact positioning of the carriage in that the carriage can be moved using a toothed rack. The toothed rack is directly mounted to the carriage and is moved by a stepping motor. It is, however, also feasible to mount the drive to the carriage, which can be moved on a stationary toothed rack.

In a particularly preferred embodiment, the front end of at least one conveyor belt of the lower transport unit can be adjusted in an upward direction beyond the transport plane. This measure facilitates up-stacking of the products to be stacked using the inventive device by lifting the front end of the folding box and thereby lifting the entire folding box such that the subsequent folding box can be pushed below the previous folding box. A stacking method of this type is generally used if the lower side of the folding box is relatively smooth and has no punching and folding edges.

The invention provides simple adjustment to this mode of stacking by guiding the front end of this conveyor belt around a deflecting roller, the deflecting roller being rotatably mounted to a shackle which can be upwardly tilted.

The stacking method can be changed from down-stacking to up-stacking, i.e. from stacking in a downward direction to stacking in an upward direction merely by turning the shackle, thereby lifting the front end of the conveyor belt. This can be effected either manually or preferably automatically. The lower transport unit is pulled forward and the upper transport unit is pushed back to release the upper stack shaft.

In its upwardly pivoted position, the shackle preferably forms a support for a section of the flat product. This is advantageous in that the flat product is supported on this support after being positioned in the stack shaft, and is lifted from the conveyor belt. This has the essential advantage that the conveyor belt does not slide along the surface of the folding box located in the stack shaft, thereby damaging it.

In a further development, a support roller which can be adjusted in a vertical upward direction beyond the transport plane is provided at a separation from the front end of at least one conveyor belt, wherein its separation from the end of the stack shaft is smaller than the length of the product to be stacked in the region of that conveyor belt. This support roller ensures that not only the front end of the product to be stacked is lifted from the transport plane, which is completely sufficient for short products, but also the rear end, which generally tends to hang downwards, and is suitable, in particular, for long products. In particular, for products having a low bending resistance, e.g. thin folding boxes, it is thereby ensured that the rear end is lifted to a sufficient degree to ensure that the subsequent folding box is safely pushed below the rear end of the previous folding box.

In accordance with the invention, the support roller is rotatably mounted to a second shackle which can be upwardly tilted. This shackle can also be upwardly tilted from its rest position into the operative position either manually or automatically. The shackle can also be adjusted in and opposite to the transport direction to adjust its position to the dimensions of the folding box.

A loop for the conveyor belt is provided for returning the conveyor belt opposite to the transport direction upstream of the support roller into the transport plane. This loop serves for exact positioning of the conveyor belt in the desired plane and can be positioned to be adjusted in and opposite to the transport direction and also in a vertical direction.

If the inventive stacking device is changed-over from up-stacking to down-stacking, the front end of at least one conveyor belt of the upper transport unit can preferably be adjusted in a downward direction below the transport plane of the lower transport unit. This ensures that the leading front edge of the flat product is disposed in a downward direction after entering the stack shaft.

In a further development, the front end of this conveyor belt is guided around a deflecting roller and the deflecting roller is rotatably mounted to a slider which is disposed to be displaceable and/or pivotable. When the stacking device is changed over from one stacking mode to the other, only the slider including deflecting roller, about which the conveyor belt is guided, need be downwardly displaced or pivoted. The front end of the upper conveyor belt is thereby adjusted such that a downward momentum is exerted on the front edge of the arriving product to be stacked.

This displacement or pivoting of the slider may also be effected manually or automatically when the upper transport unit has been pushed forward and the lower transport unit has been pushed backward to provide free entry into the lower stack shaft.

In a preferred embodiment, loops for the conveyor belt are provided adjacent to the deflecting roller. These loops lift the upper conveyor belt to such an extent that it does not collide with the front end of the lower conveyor belt and no narrowings are generated between the lower and upper conveyor belts, i.e. the transport gap has a substantially uniform size.

The position and extension of both the lower and upper conveyor belts are adjusted in accordance with the invention in that the loops are disposed to be adjustable in height and/or in the transport direction and opposite thereto. This permits exact adjustment of the extension of the conveyor belts to the shape of the folding box in the region of each conveyor belt.

In accordance with the invention, each conveyor belt has its own drive to precisely adjust the location and position of the folding box being transported as well as its orientation on the conveyor belts. The current position of the folding box is preferably detected by suitable sensors and in case of deviations from the desired position, the drives are correspondingly controlled to ensure optimum orientation of the folding boxes. Further advantages, features and details of the invention can be extracted from the dependent claims and the following detailed description of a particularly preferred embodiment with reference to the drawing. The features shown in the drawing and mentioned in the claims and in the description may be essential to the invention either individually or in arbitrary combination.

DESCRIPTION OF THE PREFERRED EMBODIMENT

Figure 1:
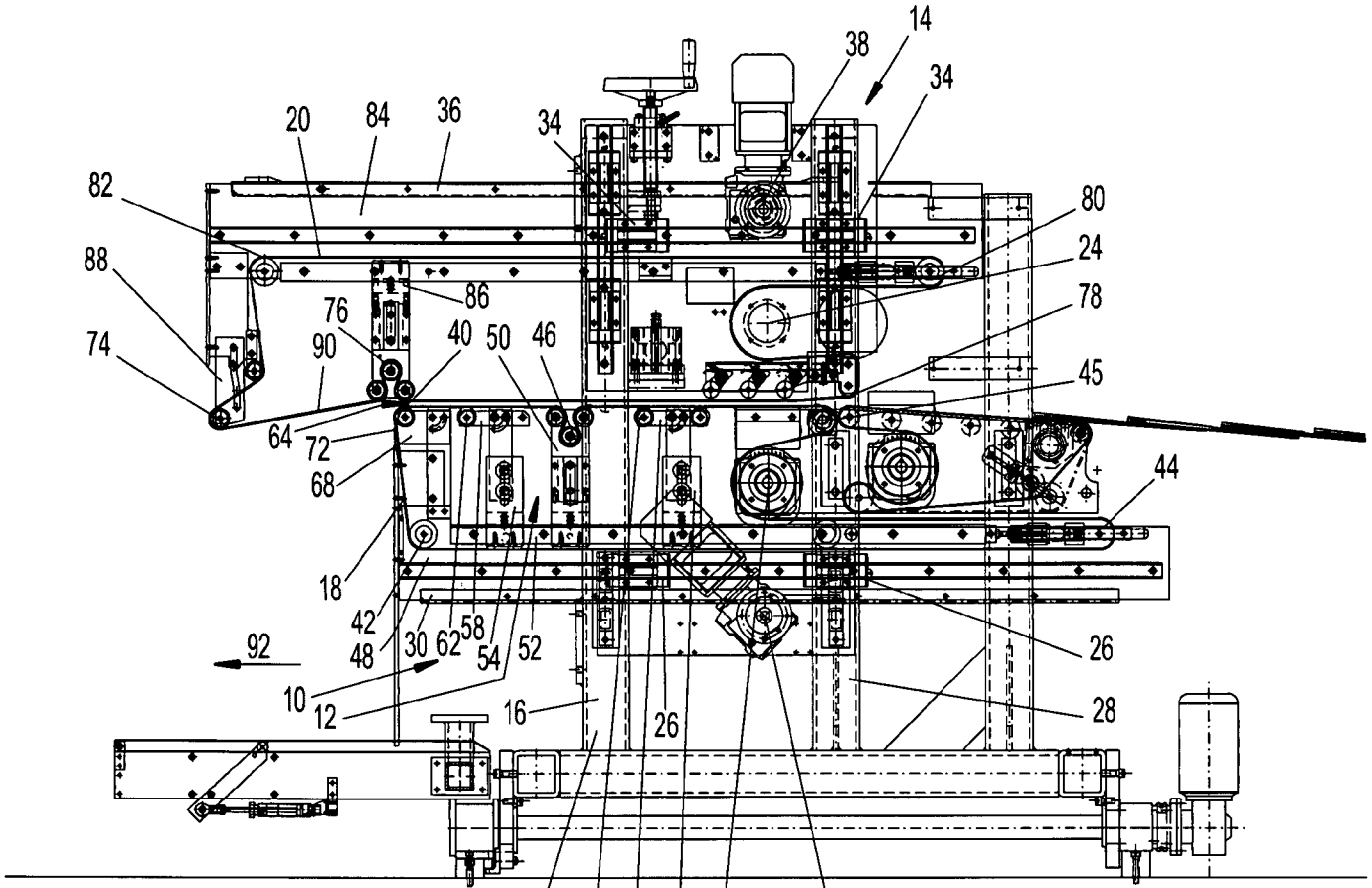
FIG. 1 shows a side view of the inventive stacking device for down-stacking.

FIG. 1 shows a stacking device which is designated in total with 10 and substantially comprises a lower transport unit 12 and an upper transport unit 14. The two transport units are mounted to a machine frame 16 and have circulating conveyor belts 18 and 20. The conveyor belts 18 and 20 are each driven by their own drives 22 and 24, independently of each other. The two conveyor belts 18 and 20 normally have the same transport speed, wherein, to correct the position of the flat products to be transported (not shown), the transport speeds may vary.

Figure 2:
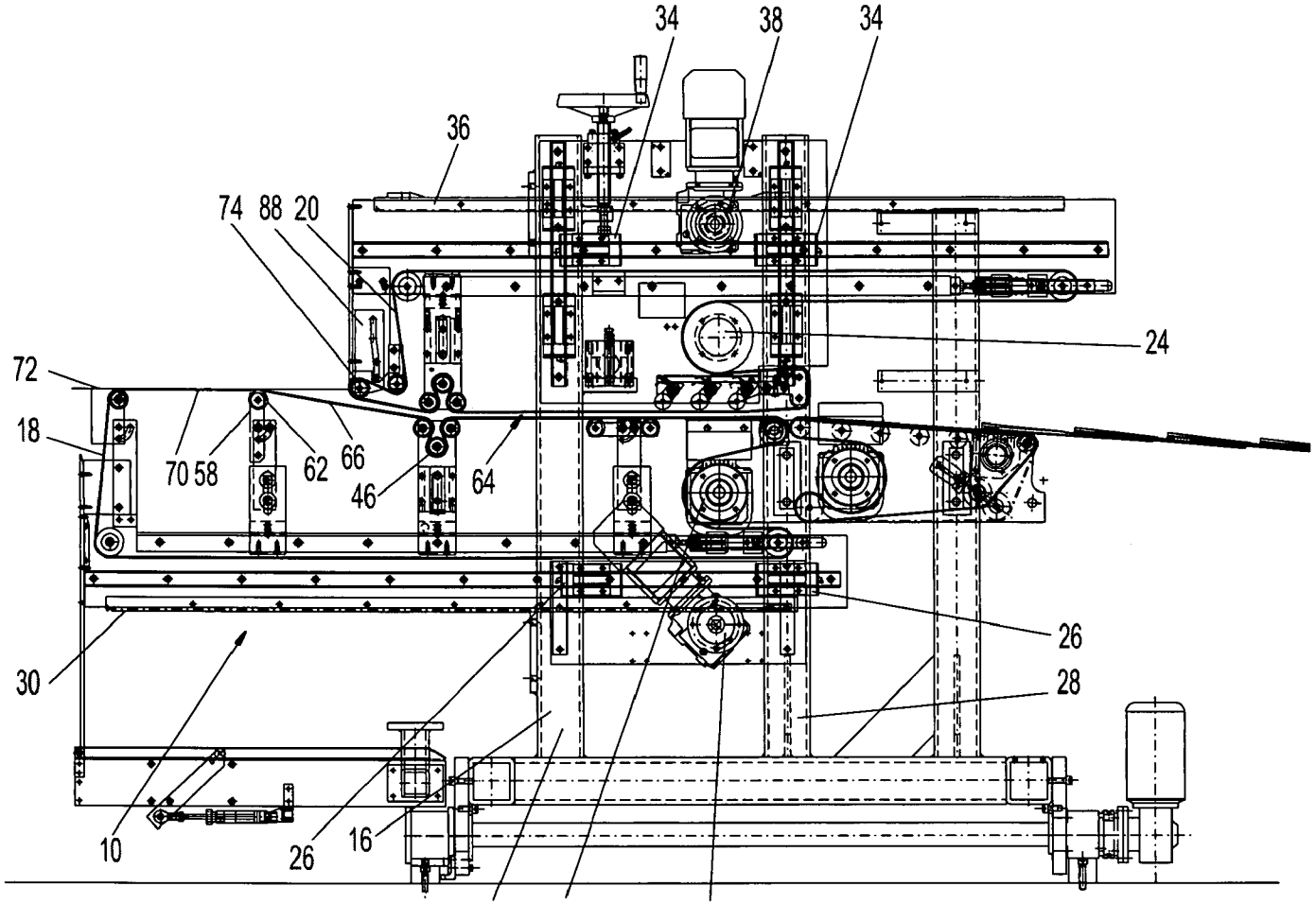
FIG. 2 shows a side view of the inventive stacking device for up-stacking.

It is clear that the lower transport unit 12 comprises bearings 26 on stands 28 of the machine frame 16, which are disposed to be displaceable in a horizontal direction, and has a toothed rack 30 on its lower side which mates with a drive 32. The horizontal position of the lower transport unit 12 is adjusted via this drive 32, i.e. the lower transport unit 12 can assume a rear position (FIG. 1) or a forward position (FIG. 2). The rear position is required for down-stacking, whereas the forward position is required for up-stacking. In correspondence thereto, the upper transport unit 14 comprises two bearings 34 which are disposed on the stands 28 to be displaceable in a horizontal direction, and also comprises a toothed rack 36 which mates with a drive. The upper transport unit 14 can also be displaced in a horizontal position between a front and rear position via this drive 38, wherein the front position is required for down-stacking (FIG. 1) and the rear position is required for up-stacking (FIG. 2).

The conveyor belt 18 of the lower transport unit 12 surrounds a first front deflecting roller 40, a second front deflecting roller 42 disposed therebelow, a rear deflecting roller 44, the drive 22, an inlet roller 45 and a loop 46. The two front deflecting rollers 40 and 42 and the rear deflecting roller 44 are thereby located on a carriage 48 which can be displaced in the bearings 26, wherein the loop 46 is mounted to a holder 50 which can be displaced on the carriage 48, in particular, on a guiding rail 52. The inlet roller 45 is mounted to the rear stand 28. The guiding rail 52 comprises two further holders 54 and 56 to which a shackle 58 and 60, respectively, are pivotably mounted. In the rest position of the shackles 58 and 60 (FIG. 1), a support roller 62 which is rotatably mounted to the shackles 58 and 60 does not lift the conveyor belt 18 out of the transport plane 64. FIG. 2 shows the shackle 58 being pivoted through 90° such that the conveyor belt 18 is lifted upwards out of the transport plane 64. The loop 46 serves to return the section 66 of the lower conveyor belt 18 located between the support roller 62 and the loop 46 back into the transport plane 64.

The front first deflecting roller 40 is mounted to a pivotably disposed shackle 68, and can be upwardly displaced by pivoting the shackle 68 (FIG. 2) such that the entire section 70 of the lower conveyor belt 18 located between this first deflecting roller 40 and the support roller 62 is located above the transport plane 64. The shackle 68 has a support 72 to support a section of a disposed flat product.

The upper conveyor belt 20 of the upper transport unit 14 surrounds a front first deflecting roller 74, a loop 76, a roller inlet 78, the drive 24, a deflecting roller 80 and a front upper deflecting roller 82. The front first deflecting roller 74, the upper deflecting roller 82 and the rear deflecting roller 80 are mounted to a second carriage 84 which bears the toothed rack 36 and can be horizontally displaced via the drive 38. The loop 76 is displaceably mounted to the carriage 84 via a holder 86. The front first deflecting roller 74 is located on a slider 88 which is mounted on the carriage 84 such that it can be adjusted substantially in a vertical direction, thereby moving the front first deflecting roller 74 into a lower position (FIG. 1) which is below the transport plane 64. The section 90 of the upper conveyor belt 20 which is thereby deflected extends to the loop 76. It is located in front of the first deflecting roller 40 of the lower conveyor belt 18.

When the stacking device 10 is adjusted as shown in FIG. 1 and a flat product to be stacked is transported in the transport direction 92 on the lower conveyor belt 18, the front end of the product is forced downwards by the section 90 of the upper conveyor belt 20 or a downward momentum is exerted on the front end. This ensures that the product to be stacked safely reaches the stack shaft located below the section 90. The lower transport unit 12 is thereby sufficiently withdrawn to the right-hand side, i.e. opposite to the transport direction 92, such that the product to be stacked is transported via the lower conveyor belt 18 to almost directly in front of the end of the stack shaft. If the cross-section of the folding box is not rectangular, the individual lower conveyor belts 18 can assume different positions such that the front ends of these conveyor belts 18 substantially follow the rear shape of the folding box.

In the setting of the stacking device 10 of FIG. 2 for up-stacking, the upper transport unit 14 is withdrawn and the sections 66 and 70 of the lower conveyor belt 18 are displaced in an upward direction out of the transport plane 64. The support roller 62 is thereby separated from a stop in the stack shaft by a distance which is shorter than the length of the product to be stacked. This means that the product to be stacked projects past the rear of the support roller 62. The next product which is supplied via the lower conveyor belt 18 can therefore be pushed initially below the projecting end of the previous product and then completely below the product. The slider 88 is thereby sufficiently displaced opposite to the transport direction 92 such that it does not collide with the products supported on the section 66. The product may additionally be held down by the deflecting roller 74, if required.

The inventive stacking device 10 permits up-stacking and down-stacking, wherein the adjustments can be made either manually and/or mechanically, in particular, via a control unit of the stacking device 19. Exchange of the stacking device in case of change of the product to be stacked is therefore avoided.

I claim:

1. A device for stacking flat products and folding boxes in a stack shaft, the device comprising:

an upper transport unit;

a lower transport unit;

an upper conveyor belt disposed on said upper transport unit, said upper conveyor belt having a front end facing the stack shaft;

a lower conveyor belt disposed on said lower transport unit, said lower conveyor belt having a front end facing the stack shaft, wherein the flat products are transported towards the stack shaft between said upper and said lower conveyor belts;

first means for extending said front end of said upper conveyor belt while retracting said front end of said lower conveyor belt, wherein vertical positions of said upper and said lower conveyor belts thereby remain substantially unchanged in association with extension and retraction thereof, said first means structured and dimensioned to permit downward stacking of the flat products below said extended front end of said upper conveyor belt and past said retracted front end of said lower conveyor belt; second means for retracting said front end of said upper conveyor belt while extending said front end of said lower conveyor belt, wherein vertical positions of said upper and said lower conveyor belts thereby remain substantially unchanged in association with extension and retraction thereof, said second means structured and dimensioned to permit upward stacking of the flat products above said extended front end of said lower conveyor belt and past said retracted front end of said upper conveyor belt; and a stack support comprising either a horizontal support for supporting the stack during downward stacking and a portion of the lower conveyor belt for supporting the stack during upward stacking.

2. The device of claim 1, wherein at least one of said upper and said lower conveyor belt can be moved away from the stack shaft by at least a length of the flat product being stacked and independently of an other one of said upper and said lower conveyor belt.

3. The device of claim 1, wherein a front and a rear end of at least one of said upper and said lower conveyor belt are each guided about a deflecting roller mounted to a common carriage, wherein said carriage can be displaced in the transport direction.

4. The device of claim 3, wherein said carriage can be moved using a linear drive, a toothed rack, a spindle, or a toothed belt drive.

5. The device of claim 1, wherein a front end of said lower conveyor belt can be adjusted in an upward direction, beyond a transport plane of the flat products.

6. The device of claim 5, wherein said front end of said lower conveyor belt is guided about a lower deflecting roller, said lower deflecting roller being rotatably mounted to a lower shackle which can be displaced and/or upwardly tilted.

7. The device of claim 6, wherein, in an upwardly pivoted position, said lower shackle forms a support for a section of a flat product.

8. The device of claim 5, further comprising a lower support roller which can be vertically upwardly adjusted beyond the transport plane and disposed at a separation from said front end of said lower conveyor belt, wherein said lower support roller is disposed at a distance from an end of a transport path, said distance being less than a length of the product to be stacked.

9. The device of claim 8, wherein said lower support roller is rotatably mounted to a second lower shackle which can be tilted upwards and/or be linearly displaced.

10. The device of claim 9, wherein said lower shackle can be exchanged.

11. The device of claim 8, wherein said lower conveyor belt has a lower loop disposed upstream of said lower support roller or of said lower deflecting roller.

12. The device of claim 1, wherein a front end of at said upper conveyor belt can be adjusted in a downward direction below a transport plane of said lower transport unit.

13. The device of claim 12, wherein said front end of said upper conveyor belt is guided around an upper deflecting roller, said upper deflecting roller being rotatably mounted to an upper slider which is disposed to be displaceable or pivotable.

14. The device of claim 12, wherein said upper conveyor belt has an upper loop disposed upstream of said upper deflecting roller.

15. The device of claim 14, wherein said upper loop is disposed to be adjustable in height or in a transport direction.

16. The device of claim 1, wherein each of said upper and lower conveyor belt has its own drive.

17. The device of claim 1, further comprising means for adjusting a separation between said upper and said lower conveyor belts.

* * * * *